US008166891B2

(12) United States Patent
Borowski et al.

(10) Patent No.: US 8,166,891 B2
(45) Date of Patent: May 1, 2012

(54) MANWAY GASKET

(75) Inventors: Andrew J. Borowski, Palos Park, IL (US); Alex V. Degutis, LaGrange Park, IL (US); David A. Oestermeyer, Downers Grove, IL (US)

(73) Assignee: Salco Products, Inc., Lemont, IL (US)

( * ) Notice: Subject to any disclaimer, the term of this patent is extended or adjusted under 35 U.S.C. 154(b) by 62 days.

(21) Appl. No.: 12/616,426

(22) Filed: Nov. 11, 2009

(65) Prior Publication Data

US 2011/0107940 A1 May 12, 2011

(51) Int. Cl.
*B61D 39/00* (2006.01)

(52) U.S. Cl. ..... 105/377.05; 105/377.07

(58) Field of Classification Search ..... 105/377.05, 105/377.07, 377.08; 220/835; 411/44; 137/437
See application file for complete search history.

(56) References Cited

U.S. PATENT DOCUMENTS 2,691,352 A * 10/1954 Bowden ..... 52/395
3,786,955 A * 1/1974 Mowatt-Larssen ..... 220/327
4,860,919 A * 8/1989 Weisel et al. ..... 220/240
4,948,185 A * 8/1990 Miller ..... 292/256.5
5,622,117 A * 4/1997 Burian et al. ..... 105/377.07
5,644,990 A * 7/1997 Seitz ..... 105/377.07
5,678,827 A * 10/1997 Burian et al. ..... 277/637
5,813,352 A * 9/1998 Bramlett et al. ..... 105/377.07
5,960,980 A * 10/1999 Burke et al. ..... 220/325
6,076,471 A * 6/2000 Burian et al. ..... 105/377.07
6,095,365 A * 8/2000 Yielding ..... 220/264
6,494,338 B1 * 12/2002 Schultz ..... 220/328
7,427,089 B2 * 9/2008 Silverio et al. ..... 292/256.5
2005/0205576 A1 * 9/2005 Bednara et al. ..... 220/328
2007/0235463 A1 * 10/2007 Wyler ..... 220/835
2009/0158959 A1 * 6/2009 Schultz et al. ..... 105/377.07

OTHER PUBLICATIONS

CTG, Inc, "*NRT Energizer*," 2 pages, http://www.ctgasket.com, last accessed Nov. 12, 2009.

* cited by examiner

*Primary Examiner* — S. Joseph Morano
*Assistant Examiner* — Jason C Smith
(74) *Attorney, Agent, or Firm* — Leydig, Voit & Mayer, Ltd.

(57) ABSTRACT

A gasket for a railroad car manway nozzle and cover includes an inner leg portion and an outer leg portion joined by a generally planar annular body portion defining an upper annular cover sealing surface and a lower annular nozzle body sealing surface. Concentric annular chevrons are formed on the upper and lower annular sealing surfaces. In one form, the chevrons have a uniform height relative to the upper and lower sealing surfaces. In a modified form, the height of the chevrons varies relative to the surfaces from which they extend. The height of the chevrons is a minimum where the gasket is radially aligned with cover clamping bolts and a maximum at radial locations midway between clamping bolts. A tab depending from the outer leg portion provides visual verification of the presence of the gasket.

10 Claims, 3 Drawing Sheets

MANWAY GASKET

BACKGROUND OF THE INVENTION

This invention is directed to a gasket for a manway opening for containment vessels such as railroad cars, particularly tank cars. More particularly it is directed to a manway gasket with enhanced sealing capability and with visual recognition capability for verification of its presence.

A manway or hatch provides access to the interior of a containment vessel such as a railroad tank car for loading, venting, cleaning and maintenance. During transit the manway opening is closed by a cover. The cover is normally hinged and latched to the loading nozzle which is the upstanding tube surrounding the opening in the car body. The nozzle may be a cylindrical tube, or it may have a rounded top edge known as a coaming.

The cover is normally attached to the car by a hinge element. It is held in place by a series of six or eight bolts equally spaced about the opening. A resilient gasket is provided between the cover and the upper edge of the nozzle or coaming to seal between planar annular surfaces on the top of the nozzle or coaming and the underside of the cover. One such gasket, normally affixed to the coaming or nozzle, is disclosed in U.S. Pat. No. 5,678,827. This design is available commercially from Salco Products, Inc., Lemont, Ill.

An adequate seal between the cover and manway opening structure is an important aspect of gasket function. It is particularly difficult to achieve because of the generally rough treatment of the edge of the coaming or nozzle during normal car usage.

In one form, the gasket includes upstanding concentric annular ribs or chevrons which contact the planar annular gasket contact surface on the under surface of the cover. These ribs, molded into the gasket about its upper sealing surface enhance the ability of the gasket to provide a fluid tight seal.

The manway cover urges the gasket against the upper edge of the coaming or nozzle. It is drawn toward closure by six or eight or more bolts equally spaced about the outer perimeter of the manway opening. Necessarily, the clamping force imparted to the gasket member by the coacting annular gasket contact surfaces on the cover an associated nozzle or coaming is maximized nearest the bolt locations. It further follows that the minimum clamping force is imparted at a location midway between bolts.

The presence of a resilient gasket element between the manway nozzle and cover is important in the operation and usage of railroad cars having manway openings. Particularly important is the capability to verify its presence from the ground level adjacent to the cars. This is a safety feature not only from the standpoint of assuring the integrity of the seal, but from the standpoint of eliminating the need for personnel to climb to the upper heights of the railroad equipment to perform manual verification.

SUMMARY OF THE INVENTION

The gasket of the present invention enhances sealing capability through employment of outwardly directed chevrons formed on the sealing surfaces of the gasket. The chevrons seal against the cooperating annular planar surfaces defined in the underside of the cover and upper edge of the manway body and accommodate irregularities present on these rigid surfaces. In its optimal form, these chevrons may be of varying height relative to the gasket planar sealing surface to accommodate unequal distribution of clamping force. Such chevrons are formed with a minimum height at locations aligned with clamping bolts and a maximum height at locations midway between spaced clamping bolts. In another form, the gasket includes a verification telltale visible from the ground level, to confirm the presence of the gasket between the manway nozzle or coaming and the associated cover.

DETAILED DESCRIPTION OF ILLUSTRATED EMBODIMENTS

Figure 1:
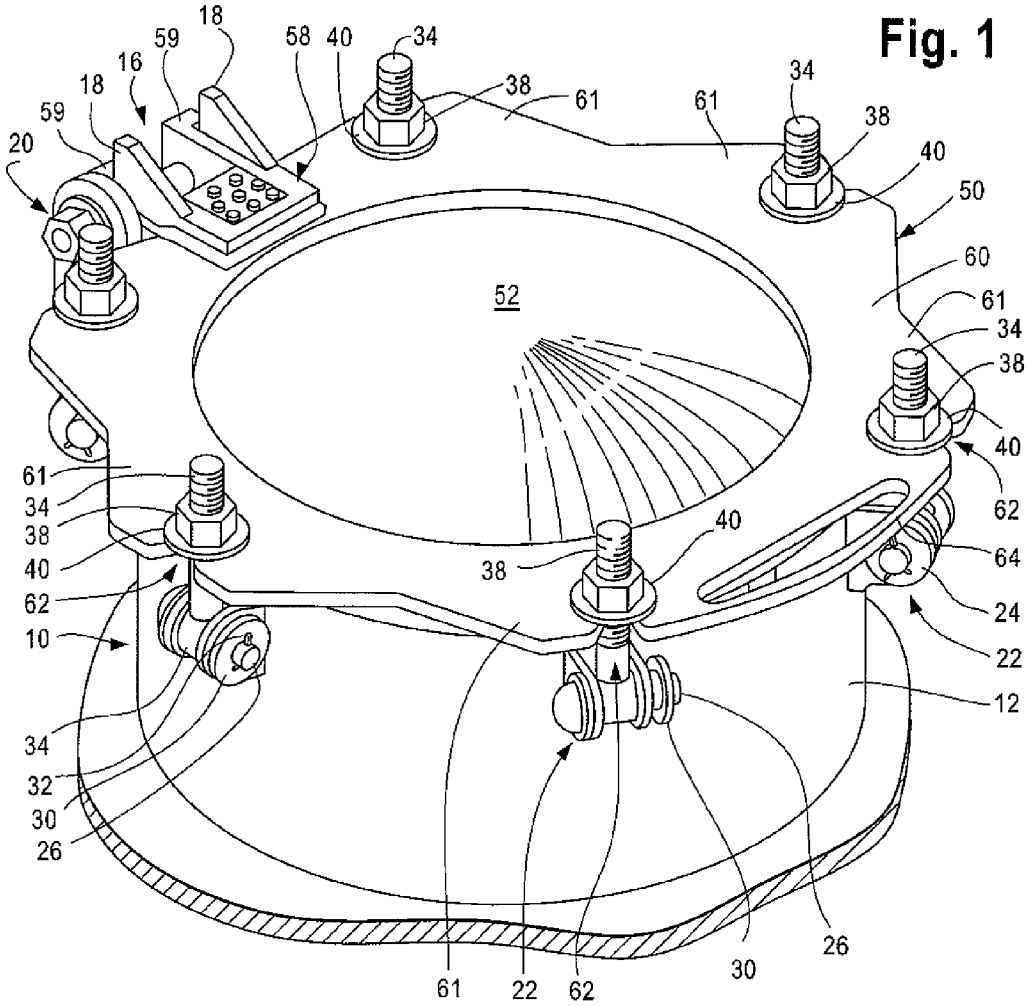
FIG. 1 is a perspective view of a manway nozzle and cover of a railroad car with an installed gasket to provide a seal between the cover and nozzle.

Referring now to the drawings, FIG. 1 illustrates a typical railroad car manway nozzle, gasket and cover arrangement generally designated 10. The manway nozzle comprises a cylindrical tubular body 12 welded to the top of a railroad car surrounding an access opening The cylindrical opening of the tubular body 12 provides access to the interior of the car to perform functions such as loading, unloading, cleaning and inspection.

The open end of the tubular manway nozzle body 12 is closed by a removable cover 50. The cover 50 is arranged to close the opening and secure the interior of the car. It can be opened to permit interior access when needed.

A resilient sealing gasket 70 is interposed between the cover 50 and manway nozzle body 12 to provide a seal between the cover 50 and the manway body 12. The general configuration of gasket 70 is disclosed in U.S. Pat. No. 5,678,827, the entire specification and drawings of which are incorporated by reference herein.

Figure 2:
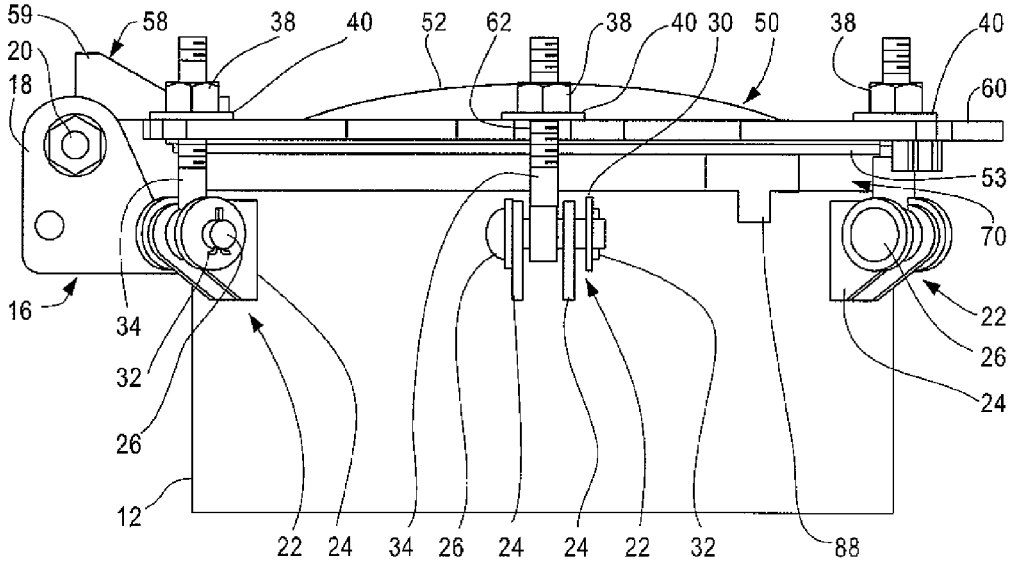
FIG. 2 is a side elevational view of the manway nozzle, cover and gasket illustrated in FIG. 1.

Referring to FIGS. 1 and 2, vertical tubular body 12 of manway nozzle 10 typically has a twenty inch (20") internal diameter. It is made of steel with a five-eighth inch (⅝") wall thickness between interior and exterior surfaces. The size is only exemplary. The nozzle tubular member could have a larger or smaller diameter.

Figure 3:
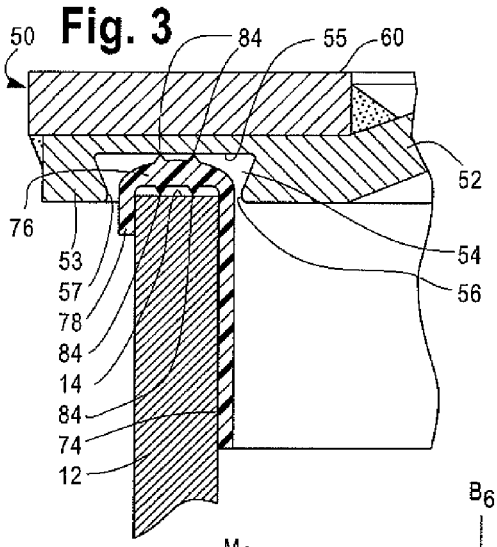
FIG. 3 is a fragmentary sectional side view of the assemblage of a manway nozzle tubular body, manway cover and gasket of FIGS. 1 and 2.

Seen in FIG. 3, tubular body 12 of the manway nozzle terminates at an upper edge in an upper generally planar annular gasket contact surface 14 which makes sealing contact with gasket 70. As seen in FIGS. 1 and 2, a cover bracket 16 includes vertically aligned spaced anus 18 welded to the manway tubular body 12 outer wall surface. The arms support a pivot bolt 20 which pivotally supports the cover 50 on the manway tubular body 12.

A plurality of securement brackets 22 are equally spaced about the manway body 12. As illustrated, there are six (6) such brackets 22. However, eight (8) could be provided, depending on the diameter of the manway body 12. Typically a manway body having a twenty inch (20") internal diameter is provided with six (6) equally spaced securement brackets 22.

Each securement bracket 22 includes two spaced apart vertical arms 24 welded to the tubular body 12. The arms 24 include aligned apertures which support a cross, or pivot pin 26. The pins 26 are removably secured to the securement brackets 22. As illustrated, each pin 26 includes a head at one end. The opposite end receives a washer 30 and cotter pin 32 to affix pins 26 in securement brackets 22.

Each securement bracket 22 supports an eye bolt 34 that includes an eyelet end pivotally mounted on one of the cross pins 26. The free end is threaded and receives a clamping nut 38 and washer 40 which engage the upper surface of cover 50. Tightening the nuts 38 draws the cover 50 toward the manway nozzle tubular body 12 to clamp the gasket 70 between the two components. For a typical twenty inch (20") diameter cover, the bolts are one inch (1") in diameter.

Cover 50 is a steel fabrication. Its shape generally corresponds to the shape of manway body 12. As illustrated in FIGS. 1 to 3, it includes a central dome portion 52 that is about the same diameter as the opening defined by manway body 12. It includes generally annular outer rim portion 53 surrounding dome portion 52 to which is welded clamping plate 60.

Cover 50 includes a hinge bracket 58 welded to clamping plate 60. Hinge bracket 58 extends outward of the cover 50 away from dome portion 52. It includes vertical flanges 59 that fit between spaced arms 18 of cover bracket 16. Vertical flanges 59 each define an aperture aligned with the aligned apertures of arms 18. Cover pivot bolt 20 extends through the apertures and pivotally secures the cover 50 to manway tubular body 12. Though not shown, the apertures in flanges 59 are vertically elongate. This configuration permits an amount of vertical play or movement necessary to adequately tighten the cover 50 onto the manway tubular body 12.

Clamping plate 60 of cover 50 also includes an elongate aperture opposite the hinge bracket 56. The plate 60 thus defines a lifting handle 64 to assist in pivotal movement of the cover 50 on cover bracket 16.

Clamping plate 60 defines a series of radial outward extensions 61 that overlie the securement brackets 22. (In the illustrated embodiment, there are six (6) such extensions.) Each extension 61 defines a slot 62 sized to receive an eye bolt 34. The slots extend radially inwardly such to permit the eye bolts 34 to be positioned vertically. On tightening of the nuts 38 upon eye bolts 34, the upper surfaces on each side of slots 62 of the extensions 61 receives the clamping load of nuts 38 and washers 40.

Referring to FIG. 3, the under surface of rim portion 53 of cover 50 includes an annular relief 54 that includes lower generally planar annular gasket contact surface 55. The radially inner terminus of relief 54 includes a rounded edge 56 formed on a diameter slightly smaller than the radially inner diameter of gasket 70. The radially outer terminus of relief 54 includes a rounded edge 57 formed on a diameter slightly larger than the radially outer diameter of gasket 70. On closure of cover 50 the gasket 70 resides within annular relief 54 between inner and outer rounded edges 56 and 57.

Figure 4:
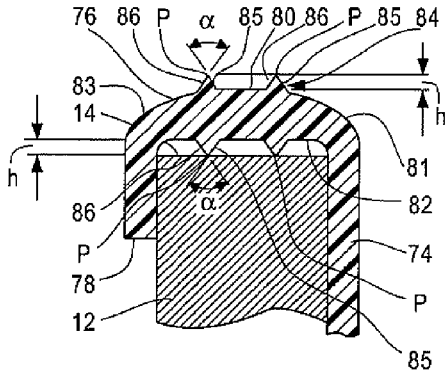
FIG. 4 is a fragmentary sectional view, on an enlarged scale, of the manway nozzle body and manway gasket of FIGS. 1 to 3 showing details of the chevrons on the cover and manway sealing surfaces of the manway gasket.

FIGS. 3 and 4 best illustrate the gasket 70 that seals between manway nozzle 10 and cover 50. The gasket can be either compression molded or injection molded from a variety of commodity-sensitive materials such as butyl rubber, Viton (a DuPont trademark), black EPDM or white nitrile. Material having a Shore A durometer of about 70-75 is suitable.

Figure 6:
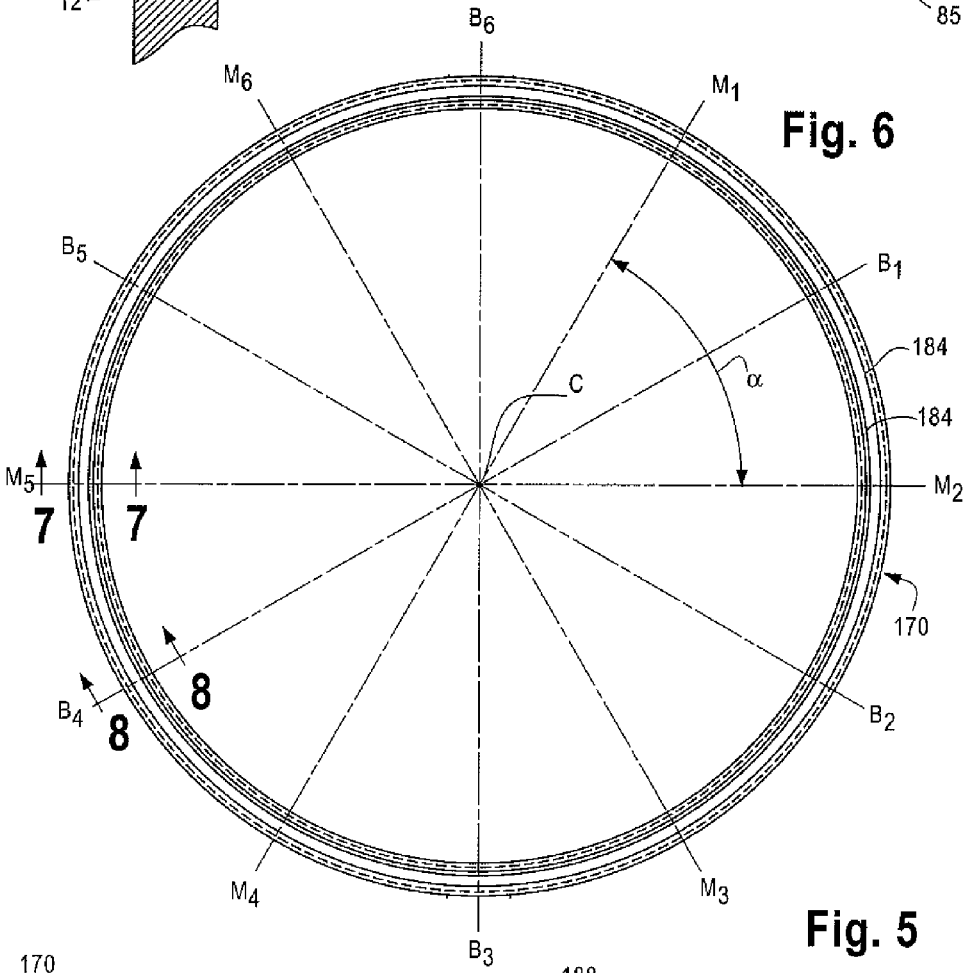
FIG. 6 is a top view of the manway gasket of FIG. 5.
Figure 5:
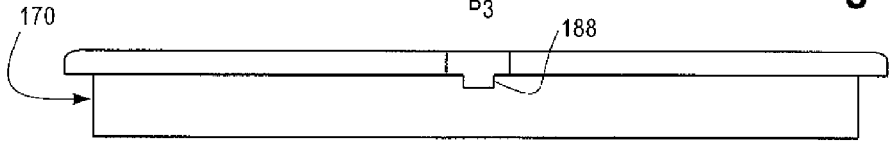
FIG. 5 is a side elevational view of a modified form of manway gasket illustrating additional features of the present invention.

The gasket is an annular ring member of an inverted J-shaped cross section formed by a generally planar annular body portion 76 with depending integrally molded inner leg portion 74 and outer leg portion 78. The legs are separated by a distance approximately equal to the wall thickness of a manway loading nozzle tubular body 12, usually five eighths inch (⅝"). The gasket 70 is cylindrical about a center (C) as illustrated in FIG. 6 which shows a somewhat modified form of gasket 170 explained in detail below. The center "C" corresponds generally to the center of the manway opening defined by manway tubular body 12.

Gasket 70 is installed onto the upper edge of tubular body 12 with generally planar annular body portion 76 overlying upper annular gasket contact surface 14. As seen in FIGS. 3 and 4, when the gasket is installed, the inner leg portion 74 engages the inner wall surface of the nozzle body and the outer leg portion 78 engages the nozzle body outer wall surface.

The underside of the generally planar annular body portion 76 overlies upper generally planar annular gasket contact surface 14 of the nozzle body. The radial inner edge 81 and radial outer edge 83 of gasket 70 are formed upon a radius of about one quarter inch (¼"). Rounding of these edges reduces the possibility of contact by the edges 56 and 57 of the cover during closing. This minimizes the risk of dislodgement of the gasket during closing.

As shown in FIG. 3, the inner leg portion 74 is substantially longer than the outer leg portion 78. Preferably, the inner leg portion 74 is about four times as long as outer leg portion 78. For reference purposes only, it has been found that an inner leg length of two inches (2") and an outer leg length of three eighths inch (⅜") (both measured from the bottom of the planar annular body portion (76) are acceptable dimensions. The leg portions 74 and 78 are one eighth inch (⅛") thick.

The generally planar annular body 76 is an annular flat ring portion that extends radially between the leg portions 74 and 78. It defines an upper annular cover sealing surface 80 and lower annular nozzle body sealing surface 82.

As illustrated in the embodiment of FIGS. 3 and 4, upper annular cover sealing surface 80 and the lower annular nozzle body sealing surface 82 are each provided with two radially spaced apart, concentric upstanding chevrons 84. These chevrons are circular, and in the illustrated form have a generally triangular cross section. Referring to FIG. 4, in the illustrated gasket, the vertical height (h) of each chevron extending upwardly from upper annular cover sealing surface 80 and downwardly from lower annular nozzle sealing surface 82 is seventy-two thousandths inch (0.072").

The chevrons 84 are defined by annular wall surfaces 85 and 86 formed at an included angle $\alpha$ of eighty degrees (80°) and each define a circular peak (P). The peak (P) of the radially outer chevron is 3/16 inch inward from the inner cylindrical surface of outer leg 78. The peaks (P) of the radially outer and radially inner chevrons are one quarter inch (¼") apart. The height (h) and angle $\alpha$ can be varied depending on the application. It is, of course, important that the chevrons 84 be readily deformable on exertion of compression forces between the cover 50 and manway body 12 to fill any irregularities in the associated contact surfaces on the manway body 12 or cover 50. The cross-sectional shape of the chevrons 84 may be other than triangular. For example, the cross-sectional shape could be semi-circular, or other suitable shape.

With the gasket 70 installed on manway tubular body 12 the chevrons 84 depending from lower annular nozzle sealing surface 82 rest on planar upper annular gasket contact surface 14. To close the manway opening, the eye bolts 34 are pivoted to a downward position with the free ends below the cross pins 26. The clamping nuts 38 are unthreaded a sufficient distance to permit pivoting of the bolts into slots 62 with the nuts 38 and washers 40 positioned above the extensions 61. The cover 50 is pivoted on cover pivot bolt 20 to overlie the manway tubular body 12. The planar annular gasket contact surface 55 makes contact with gasket 70 at chevrons 84 of upper annular cover sealing surface 80. The eye bolts 34 are then pivoted into slots 62 with clamping nuts 38 and washers 40 above the upper surface of the extensions 61 of plate 60. The nuts 38 are tightened to draw the cover 50 downward onto the tubular body 12 in overlying relation to the manway opening of manway body 12. The gasket 70 is clamped between the planar annular gasket contact surface 14 of manway body 12 and planar annular gasket contact surface 55 of cover 50. The applied compressive forces deform chevrons 84 on upper annular cover sealing surface 80 and lower annular nozzle body sealing surface 82 to provide a fluid tight seal between the manway nozzle body 12 and cover 50. The nuts 38 are typically tightened to one hundred foot pounds (100 ft-lbs).

Easy verification of the presence of gasket 70 from ground level adjacent the car is provided through incorporation of a telltale or tab 88, seen in FIG. 2. In the illustrated arrangement, integrally molded onto outer leg portion 78 are two depending verification tabs 88 one hundred eighty degrees (180°) apart. Each tab is about one inch (1") wide and extends downwardly from outer leg portion 78 about one half inch (½").

To augment visibility, the tabs 88 and, if desired, the exposed portion of outer leg portion 78 adjacent either side of tabs 88, are covered with a reflective media such as tape or paint. Thus, the tab is readily visible at night when illuminated by a light source utilized by inspection personnel.

It should be noted that the position of tabs 88 is an important consideration when installing gasket 70. Because there are two, the tabs can be visible from either side of a railroad car. But it is important to locate the tabs such that they are not obscured by securement brackets 22 and eye bolts 34. Usually, the cover hinge bracket 58 is positioned on the longitudinal centerline of the car. With a six eye bolt arrangement, two securement brackets 22 and associated eye bolts reside on a line transverse to the car longitudinal centerline. Therefore, it is desirable to position the gasket 70 such that the tabs 88 reside midway between adjacent securement brackets. In the six bolt configuration, the optimum position of the tabs 88 would be on a radial line passing through the center C of the gasket 50 at 60° to the longitudinal centerline of the car.

To orient the verification tabs relative to cover 50, the longitudinal centerline of the cover is deemed to pass through the center of dome 52 and bisect the space between vertical flanges 59 of hinge bracket 58. Thus, properly oriented tabs 88 would lie on a line that bisects the tabs and is at an angle of sixty degrees (60°) to the longitudinal centerline of the cover. Of course, the important factor in orienting the verification tabs 88 is to avoid disposition radially behind or inward of a securement bracket 22 and eye bolt 34. Therefore, though not optimal, the angle of a line that bisects tabs 88 to the longitudinal centerline of the cover could vary substantially so long as the visibility of the tabs from the ground adjacent the sides of the car is not completely impaired.

In the embodiment of FIGS. 1 to 4, and as shown in FIG. 3, the chevrons 84 are formed at a uniform height relative to the upper annular cover sealing surface 80 and lower annular nozzle sealing surface 82. Such an arrangement, considered a significant advance over prior known arrangements. The spaced circular rings formed by the chevrons 84 on both the upper annular cover sealing surface 80 and lower annular nozzle sealing surface 82 ensure improved sealing effectiveness against the associated gasket contact surfaces 14 and 55 of the nozzle body 12 and cover 50. The readily deformable chevrons 84 accommodate irregularities in the rigid metallic sealing surfaces and assure a fluid tight seal of the manway and its cover.

Referring now to FIGS. 5 to 9, the invention contemplates a more complex configuration. The loading of the manway gasket is accomplished by tightening the clamping nuts 38 with washers 40 upon eye bolts 34 to draw the planar annular gasket contact surface 55 of cover 50 toward the planar upper annular gasket contact surface 14 of upper edge of tubular body 12 of manway nozzle 10. Necessarily such a configuration imparts maximum clamping forces radially aligned with the bolts. Also, clamping force is therefore at its minimum at radial locations midway between securement brackets 22. The bolt spacing, here shown as six equally spaced bolts, therefore maximum clamping force is imparted to the gasket 170 at intervals of sixty degrees (60°). Minimum clamping force is likewise experienced at sixty degrees (60°) intervals, thirty degrees (30°) from the maximum force applications.

In the embodiment of FIGS. 5 through 9, a gasket 170 is configured as is the gasket 70 of FIGS. 1 to 4, except it includes chevrons 184 formed with a varying height "h" circumferentially about the annular surface from which they extend. This variation is intended to compensate for the disparity of clamping force around the gasket 170.

Figure 7:
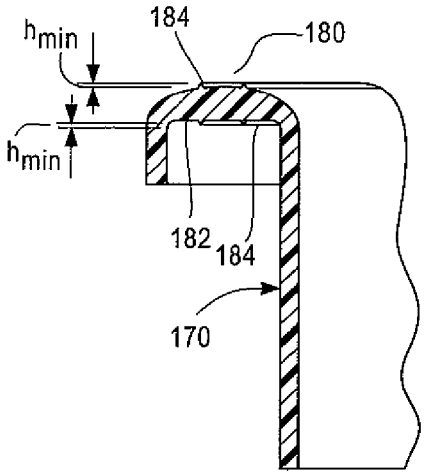
FIG. 7 is a fragmentary sectional view on an enlarged scale of the manway gasket of FIGS. 5 and 6 taken along the line 7-7 of FIG. 6.
Figure 8:
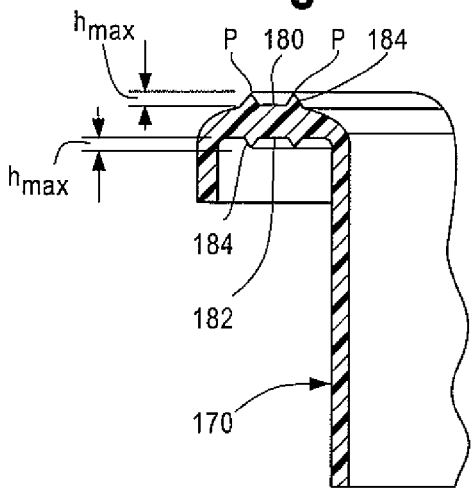
FIG. 8 is a fragmentary, sectional view, on an enlarged scale, of the gasket of FIGS. 5 and 6 taken along the line 8-8 of FIG. 6.
Figure 9:
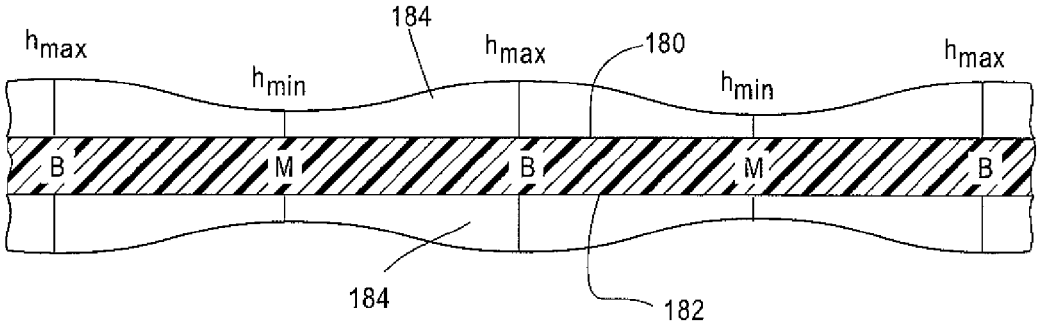
FIG. 9 is a graphic schematic showing the varying height of the chevrons relative to the sealing surfaces of the gasket.

Referring to FIGS. 7 and 8, the height "h" of the chevrons 184 relative to the upper annular cover sealing surface 180 and lower annular nozzle sealing surface 182, is a minimum at locations $M_1$ to $M_6$ and maximum at locations $B_1$ to $B_6$. The height of the chevrons relative to surface from which they extend circumferentially about gasket 170 of each chevron 184 is generally defined by a sinusoidal pattern.

As in the embodiment of FIGS. 1 to 4, the height (h max) at locations $B_1$ to $B_6$ is seventy-two thousandths inches (0.072"). The height ($h_{min}$) diminishes to ten thousandths inch (0.010") at locations $M_1$ to $M_6$. As illustrated schematically in FIG. 9, the height of chevrons 184 relative to upper annular cover sealing surface 180 and lower annular nozzle sealing surface 182 define locations of minimum height "$h_{min}$" at positions $M_1$ to $M_6$ and locations of maximum height "$h_{max}$" at positions $B_1$ to $B_6$. For a manway having six (6) securement brackets 22 the gasket 170 includes six locations, sixty degrees (60°) apart where the height of the chevrons is a minimum ($h_{min}$) and six (6) locations midway between the locations of minimum height, where the height is a maximum ($h_{max}$).

The gasket 170 is installed such that locations $M_1$ to $M_6$ seen in FIG. 7 are radially aligned with the securement brackets 22 where eye bolts 34 and clamping nuts 38 exert a clamping force upon the gasket 170. The locations $B_1$ to $B_6$ seen in FIG. 8 are radially aligned midway between the locations $M_1$ to $M_6$ and are therefore most distant from adjacent clamping forces. This relationship provides a minimum height "$h_{min}$" for the chevrons 184 radially aligned with the securement brackets 22 and a maximum height "$h_{max}$" for the chevrons 184 circumferentially midway between bracket 22. This arrangement improves uniformity of sealing contact between the chevrons 184 and the gasket contact surface 14 of manway nozzle body 12 and gasket contact surface 55 on cover 50.

In this embodiment, external tabs 188 are molded onto the gasket outer leg portion 178 at a radial location aligned with locations of maximum height "$h_{max}$" of the chevrons 184. To properly orient the varying height of chevrons 184 relative to the securement brackets 22 it is only necessary to position the external tabs 188 midway between adjacent securement brackets 22. As previously explained to take maximum advantage of the visual verification capability provided by the tabs 188, it is necessary to position the tabs 188 on the sides of the manway nozzle 12 most visible from the ground adjacent the railroad car. That is, for a manway having six (6) securement brackets the tabs 88 should lie on a radial line passing through center "C", sixty degrees (60°) to the longitudinal centerline of the car.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A gasket for sealing between the manway nozzle of a containment vessel and an associated cover comprising:

an annular ring member having a generally planar annular body portion defining an upper annular cover sealing surface and a lower annular nozzle body sealing surface, each said sealing surface including at least one annular upstanding chevron extending therefrom, wherein each said at least one upstanding chevron extending from said upper annular cover sealing surface and said lower annular nozzle body sealing surface is of varying height circumferentially about said generally planar annular body portion relative to said upper annular cover sealing surface and said lower annular nozzle body sealing surface, and wherein said chevrons have locations of maximum height ($h_{max}$) at a plurality circumferentially spaced locations about said generally planar annular body portion, and a plurality of locations of minimum height ($h_{min}$) midway between said locations of maximum height ($h_{max}$), wherein said upper annular cover sealing surface and said lower annular nozzle body sealing surface each include two concentric radially spaced apart chevrons extending therefrom, wherein the height of the chevrons relative to the surface from which they extend circumferentially about said gasket defines a generally sinusoidal pattern, and wherein said gasket includes a radial outer leg portion depending from said generally planar annular body portion radially outward of said chevrons, and at least one tab depends from said radial outer leg portion radially aligned with one of said locations where the height of said chevron is at a maximum ($h_{max}$).

2. A gasket as claimed in claim 1 wherein the height of the chevrons relative to the surface from which they extend circumferentially about said gasket defines a generally sinusoidal pattern.

3. A gasket as claimed in claim 1 wherein two tabs depend from said radially outer leg portions one hundred eighty degrees (180°) apart.

4. A railroad car having a tubular manway body defining an access opening, said body having an upper generally planar annular gasket contact surface, a cover pivotally mounted to said manway body to close said opening, defining a lower generally planar annular gasket contact surface, a resilient gasket interposed between said tubular manway body and said cover comprising an annular ring member having a generally planar annular body portion defining an upper annular cover sealing surface and a lower annular nozzle body sealing surface, each said sealing surface including at least one annular upstanding chevron extending therefrom, wherein said upper annular cover sealing surface and said lower annular nozzle body sealing surface includes two concentric radially spaced apart chevrons extending therefrom, wherein said manway body includes a plurality of securement brackets disposed about said opening an eyebolt pivotally supported on each said securement bracket, each said eyebolt including a threaded end and a threaded nut thereon, said cover including a clamping plate having a plurality of slots aligned with said securement brackets sized to receive said eye bolts with said nuts positioned above said clamping plate, said gasket disposed between said upper generally planar annular gasket contact surface of said manway body and said lower generally planar annular gasket contact surface of said cover, said nuts positioned on said eyebolts to urge said cover toward said manway body to compress said chevrons on said annular nozzle body sealing surface against said planar upper annular upper gasket contact surface of said nozzle body and said chevrons on said lower annular nozzle body sealing surface against said planar annular gasket contact surface of said cover, wherein each of said at least one upstanding chevrons extending from said upper annular cover sealing surface and said lower annular nozzle body sealing surface is of varying height circumferentially about said generally planar annular body portion relative to said upper annular cover sealing surface and said lower annular nozzle body sealing surface, and wherein said chevrons have locations of maximum height ($h_{max}$) at a plurality of circumferentially spaced locations about said generally planar annular body portion, a plurality of locations of minimum height ($h_{min}$) midway between locations of maximum height and wherein said locations of minimum height ($h_{min}$) are radially aligned with said securement brackets.

5. A railroad car as claimed in claim 4 wherein said manway body defines an inner wall surface and an outer wall surface, said gasket includes a radial outer leg portion contacting said radial outer wall surface, said radial outer leg portion including at least one tab portion depending from said radial outer leg portion.

6. A railroad car as claimed in claim 5 wherein said radial outer leg portion includes two tabs depending therefrom located one hundred eighty degrees (180°) apart.

7. A railroad car as claimed in claim 4 wherein the height of the chevrons relative to the surface from which they extend circumferentially about said gasket defines a generally sinusoidal pattern.

8. A railroad car as claimed in claim 4 wherein said manway body defines an inner wall surface and an outer wall surface, said gasket includes a radial outer leg portion contacting said radial outer wall surface, said radial outer leg portion including at least one tab portion depending from said radial outer leg portion.

9. A railroad car as claimed in claim 8 wherein said radial outer leg portion includes two tabs depending therefrom located one hundred eighty degrees (180°) apart.

10. A railroad car having a tubular manway body defining an access opening, said body having an upper generally planar annular gasket contact surface, a cover pivotally mounted to said manway body to close said opening, defining a lower generally planar annular gasket contact surface, a resilient gasket interposed between said tubular manway body and said cover comprising an annular ring member having a generally planar annular body portion defining an upper annular cover sealing surface and a lower annular nozzle body sealing surface, each said sealing surface including at least one annular upstanding chevron extending therefrom, wherein said upper annular cover sealing surface and said lower annular nozzle body sealing surface includes two concentric radially spaced apart chevrons extending therefrom, wherein said manway body includes a plurality of securement brackets disposed about said opening, an eyebolt pivotally supported on each said securement bracket, each said eyebolt including a threaded end and a threaded nut thereon, said cover including a clamping plate having a plurality of slots aligned with said securement brackets sized to receive said eye bolts with said nuts positioned above said clamping plate, said gasket disposed between said upper generally planar annular gasket contact surface of said manway body and said lower generally planar annular gasket contact surface of said cover, said nuts positioned on said eyebolts to urge said cover toward said manway body to compress said chevrons on said annular nozzle body sealing surface against said planar upper annular upper gasket contact surface of said nozzle body and said chevrons on said lower annular nozzle body sealing surface against said planar annular gasket contact surface of said cover wherein said chevrons have locations of maximum height ($h_{max}$) at a plurality of circumferentially spaced locations about said generally planar annular body portion, a plurality of locations of minimum height ($h_{min}$) midway between locations of maximum height and wherein said locations of minimum height ($h_{min}$) are radially aligned with said securement brackets wherein said manway body defines an inner wall surface and an outer wall surface, said gasket includes a radial outer leg portion contacting said radial outer wall surface, said radial outer leg portion including at least one tab portion depending from said radial outer portion wherein said radial outer leg portion includes two tabs depending therefrom located one hundred eighty degrees (180°) apart wherein said tabs are aligned with locations of maximum height ($h_{max}$) of said chevrons.

* * * * *